US005484087A

United States Patent [19]

Negrych

[11] Patent Number: 5,484,087

[45] Date of Patent: Jan. 16, 1996

[54] SCREWTOP CONTROLLED VISCOUS MATERIALS DISPENSER

[76] Inventor: Colin E. Negrych, 263 W. End Ave., New York, N.Y. 10023

[21] Appl. No.: 320,968

[22] Filed: Oct. 12, 1994

[51] Int. Cl.[6] ..... B67D 5/42

[52] U.S. Cl. ..... 222/390; 222/531; 116/323

[58] Field of Search ..... 222/390, 534, 222/531, 47; 116/281, 282, 306, 307, 321, 323, 324; 73/290 R; 277/2, 165

[56] References Cited

U.S. PATENT DOCUMENTS

| | | | |
|---|---|---|---|
| Re. 24,440 | 3/1958 | Groen | 277/165 |
| 1,691,861 | 11/1928 | Stout | 222/390 X |
| 3,111,245 | 11/1963 | Libit et al. | 222/534 |
| 3,339,810 | 9/1967 | Block et al. | 222/390 X |
| 3,420,417 | 1/1969 | Kardel | 222/390 |
| 4,144,988 | 3/1979 | Bergman | 222/390 |
| 4,506,810 | 3/1985 | Goncalves | 222/391 |
| 4,753,373 | 6/1988 | Seager | 222/390 |
| 4,762,251 | 8/1988 | Berger | 116/321 X |
| 4,850,516 | 7/1989 | Seager | 222/390 |
| 4,899,909 | 2/1990 | Summons et al. | 222/47 |
| 4,921,130 | 5/1990 | Hollberg | 222/390 X |
| 4,964,548 | 10/1990 | Kenyon, Jr. | 222/521 |
| 5,111,588 | 5/1992 | Wung et al. | 33/367 |
| 5,303,850 | 4/1994 | Connan | 222/153 |
| 5,305,932 | 4/1994 | Iseli | 222/521 |

*Primary Examiner*—Gregory L. Huson
*Attorney, Agent, or Firm*—Goldstein & Associates

[57] ABSTRACT

The invention is a viscous materials dispenser, comprising a housing having side walls defining a hollow interior space, a housing top having a housing top opening in communication with the hollow interior space in which viscous material is contained, and a base. A cap is seated on the housing top where it may rotate, the cap plug extending into the housing top opening. A threaded rod extends from the cap to the base, the threaded rod mated with the cap so that it rotates with the cap. A piston mounted between the side walls advances toward the cap when the cap and threaded rod are rotated. The cap has a lower chamber that extends into the cap plug that is in fluid communication with the hollow interior space through a plurality of polygonal holes, and also has a spout cavity in fluid communication with the lower chamber. The cap has a spout, mounted within the spout cavity and also has a conduit. The spout pivotable within the spout cavity between an open and a closed position to bring the conduit into and out of fluid communication with the lower chamber.

15 Claims, 2 Drawing Sheets

SCREWTOP CONTROLLED VISCOUS MATERIALS DISPENSER

BACKGROUND OF THE INVENTION

The invention relates to a device for dispensing viscous materials such as toothpaste, syrups, caulks, and the like. More particularly, the invention relates to an advancing piston dispenser.

Viscous materials have special dispensing problems due to their inherent properties. They cannot be poured from a container, nor can they be handled directly. Generally the only way to dispense a viscous material is to squeeze or push it out of a container.

The most common method of dispensing a viscous material is by squeezing a container enclosing the material. The material is forced out of an opening by the pressure of the container upon the material. Often this dispensing method is used with tube shaped containers that contain a variety of materials, including toothpaste. This method has a severe limitation, in that it is usually not possible to squeeze out all of the material from the container, and the remainder is always wasted. The consumer is faced with the dilemma of struggling to extract the remaining material, or needlessly wasting it. Further, it is difficult to simultaneously exert sufficient force upon the container the expel some of the material while careful controlling the dispensing. Thus, often either too little or too much material is dispensed. In addition, the material cannot be dispensed onto the precise desired location.

Another common method of dispensing viscous materials comprises an apparatus wherein viscous materials are forced out of a storage chamber by an advancing piston. Typically, the piston is advanced incrementally along a notched rod toward a discharge orifice. The piston may be continually advanced until it reaches the limit of its travel, which is typically near, but not at, the opening. In operating many of these types of devices, the operator must often grip component parts which are covered with the viscous material to be dispensed. The result is often slippage which lessens the quantity of material dispensed, or prevents completely the dispensing of any viscous material. In addition, since the piston is advanced incrementally, it is extremely difficult to control the quantity of material dispensed. The sudden surge of each notch realized can cause a large volume of material to leave the dispenser unexpectedly.

These problems are especially acute among the elderly, young children, people with arthritis and other people that have difficulty exerting sufficient force to expel the materials and sufficient motor ability to control the material's output. Since household materials, including toothpaste and syrup often must be dispensed by these groups of people, these dispensing methods are undesirable for such products.

U.S. Pat. No. 4,753,373 to Seager discloses a positive displacement dispenser comprised of numerous moving parts which dispenses material upon depression of an actuating lever drive bar assembly which turns a rotatable wheel, thus turning a threaded rod and drawing a piston towards a discharge orifice located along the outer edge of its housing.

U.S. Pat. No. 4,850,516 to Seager discloses a positive displacement dispenser comprised of numerous moving parts, which dispenses material upon depression of an actuating lever drive bar assembly which turns a rotatable wheel, thus turning a threaded rod and drawing a piston towards the discharge orifice. A one-way mechanism is also provided for, to prevent the piston from retracting within the chamber.

U.S. Pat. No. 4,506,810 to Goncalves discloses a dispensing device comprising a reciprocating rack assembly which, when activated by a manually operated push-button assembly, forces a piston through a cylinder towards a dispensing orifice opposite the pushbutton assembly.

U.S. Pat. No. 5,303,850 to Connan discloses a dispensing cap comprising a one piece cap having a dispensing outlet which is aligned with a dispensing outlet in the neck of a bottle upon rotation of the cap.

U.S. Pat. No. 5,305,932 to Iseli discloses a permanent, snap-on, twist open cap and dispenser.

U.S. Pat. No. 4,144,988 to Bergman discloses a twist top actuated dispenser wherein manual rotation of a twistable projection causes a piston to advance towards an opposite end, thus dispensing material from a fixed spout at that opposite end.

U.S. Pat. No. 4,964,548 to Kenyon Jr. discloses a dispensing closure having an interior sealing sleeve, a threaded sleeve engaging a threaded tube, and stop blocks limiting twisting of the closure cap.

While these units units may be suitable for the particular purpose employed, or for general use, they would not be as suitable for the purposes of the present invention as disclosed hereafter.

SUMMARY OF THE INVENTION

It is an object of the invention to produce a dispenser capable of dispensing viscous materials, that is designed for economical and inexpensive manufacture. The parts are designed so that they can be assembled by nested bipartite construction, or by a similar process.

In is another object of the invention to provide a dispenser that allows for easy control of the material dispensed.

It is a further object of the invention to produce a dispenser that allows easy, convenient dispensing of viscous materials, that may be operated even by persons having motor difficulties or other physical impairments.

It is a still further object of the invention to eliminate wasted material by dispensing nearly all of the contents of the container, and by preventing inadvertent dispensing or spilling.

It is yet another object of the invention to provide indicia that allow careful control of the quantity dispensed so as to allow the dispensing of a specified measured quantity.

The invention is a viscous materials dispenser, comprising a housing having side walls defining a hollow interior space, a housing top having a housing top opening in communication with the hollow interior space in which viscous material is contained, and a base. A cap is seated on the housing top where it may rotate, the cap plug extending into the housing top opening. A threaded rod extends from the cap to the base, the threaded rod mated with the cap so that it rotates with the cap. A piston mounted between the side walls advances toward the cap when the cap and threaded rod are rotated. The cap has a lower chamber that extends into the cap plug that is in fluid communication with the hollow interior space through a plurality of polygonal holes, and also has a spout cavity in fluid communication with the lower chamber. The cap has a spout, mounted within the spout cavity and also has a conduit. The spout pivotable within the spout cavity between an open and a closed position to bring the conduit into and out of fluid communication with the lower chamber.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
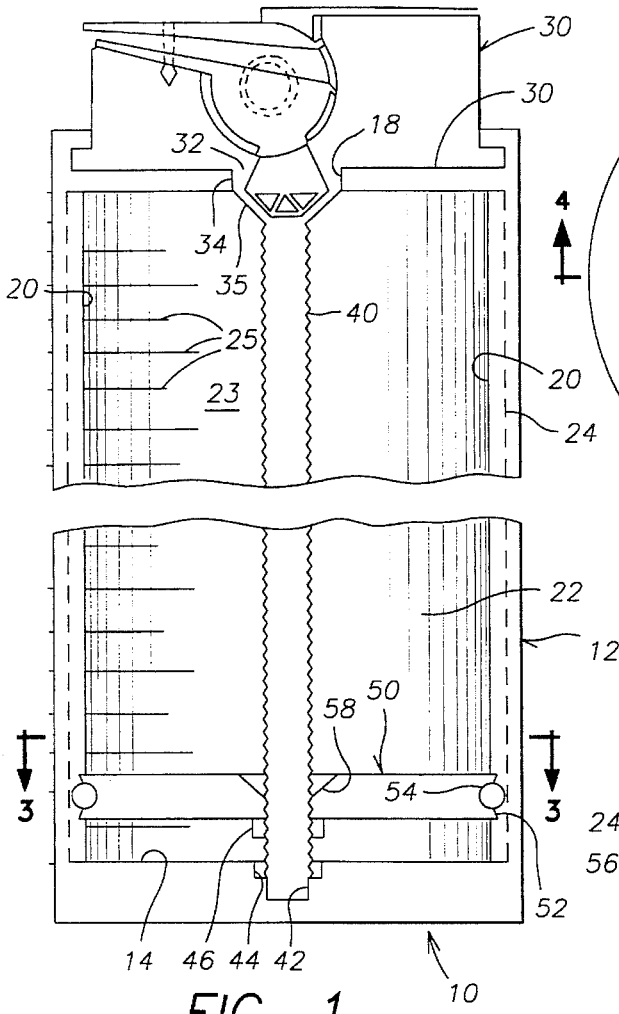
FIG 1 is a cross sectional view of the instant invention, shown with parts broken away.

FIG. 1 illustrates a viscous material dispenser 10, comprising a housing 12. The housing 12 has a base 14, and a housing top 16. The housing top 16 has a housing top opening 18. The housing top 16 and base 14 are connected by side walls 20, which extend vertically and substantially parallel to one another. The side walls 20 define a hollow interior space 22 in which viscous material to be dispensed is stored. Although the preferred shape for the housing is a cylinder, other shapes having parallel vertical side walls may be used, such as an oval-base cylinder or a rectangular prism. Herein a cylindrical housing is described, therefore the terms side wall and side walls are used interchangeably throughout the specification.

The housing 12 may have a transparent portion 23 through which the contents of the hollow interior space may be viewed. The transparent portion may bear dosage indicia 25, comprising a plurality of equally spaced horizontal lines. The equally spaced horizontal lines may differ in length, to reflect dispensing units and fractional dispensing units.

The housing has at least one guide rail 24, extending vertically along the side wall 20 between the base 14 and housing top 16.

The viscous material dispenser 10 further comprises a cap 30. The cap 30 is seated on the housing top 16 where it is rotatable thereupon. The cap has a cap plug 32 which extends through the housing top opening 18. The cap plug 32 has a neck 34 which is substantially the same diameter as the housing top opening 18.

A threaded rod 40 extends through the hollow interior space 22 from the cap 30 to the base 14. The threaded rod 40 is mated to the cap 30, so that the threaded rod 40 rotates when cap 30 is rotated. The apparatus used to mate the threaded rod to the cap may vary, but preferably, the cap plug 32 should have a cuff that fits over an end of the threaded rod, with the threaded rod having splines that mate with corresponding structure inside the cuff. The threaded rod 40 extends into the base 14 in a base well 42, where it is stabilized but is allowed to rotate freely. The cap plug 32 is conical in shape, tapering from the neck 34 to the threaded rod 40 along a tapered portion 35.

A piston 50, having a center, is mounted on the threaded rod 40 wherein the threaded rod extends through the center of the piston 50 and is substantially perpendicular to the piston 50. The piston 50 is substantially flat and has an outer edge 52 that matches the shape of the side walls 20. The piston 50 advances towards the cap 30 upon rotation of the threaded rod, pushing the material in the hollow interior space 22 toward the cap 30.

Figure 3:
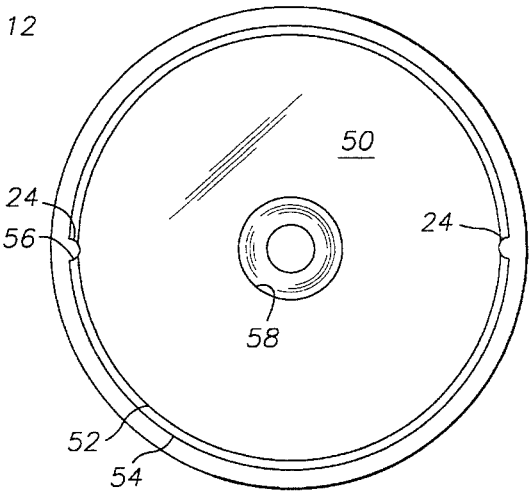
FIG. 3 is cross-sectional view, illustrating the piston, indicated by line 3—3 in FIG. 1.

Referring to both FIG. 1 and FIG. 3, the piston outer edge 52 is encircled by a rubber seal 54 which creates a tight seal with the side walls 20. The rubber seal may comprise a uniform ring shape, or may be notched to match the guide rails 24. In the first case a rail notch 56 is formed by pinching the ring shape of the rubber seal at the guide rail 24. In the latter case, the rail notch 56 is formed by the pinched area of the rubber seal 54 itself. The rubber seal 54 may further comprise a colored ring which is visible through the transparent portion 23 of the housing 12. The position of the colored ring may be monitored in conjunction with the dosage indicia 25 during dispensing to monitor the quantity of viscous material being dispensed.

The piston 50 has a countersink 58 which is concentric with the threaded rod 40. The countersink 58 matches the taper of the tapered portion 35 of the cap plug 32, so that when the piston is advanced fully toward the cap 30, the cap plug 32 extends into the counter sink, allowing the piston 50 to reach a position where it is virtually flush with the housing top 16.

The base well 42 further comprises a well counterbore 44, extending into the base 14, and concentric with the threaded rod 40. The piston 50 has a piston plug 46, concentric with the threaded rod 40. The piston plug 46 matches the well counterbore 44, so that the piston plug 46 may extend fully into the well counterbore 44, so that the piston may initially start advancing from a position where it is flush with the base 14. This maximizes the volume of the hollow interior space 22, to maximize the amount of viscous material that is initially contained therein.

Figure 4:
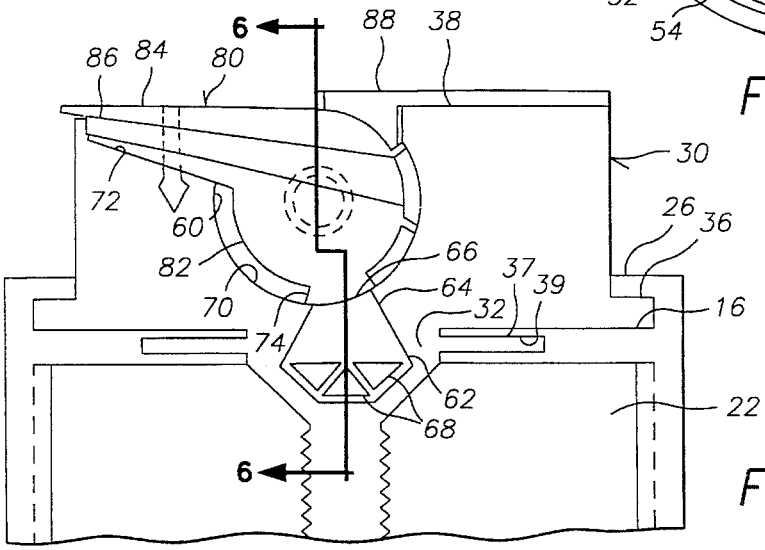
FIG. 4 is an enlarged cross-sectional view of a portion of the instant invention, indicated by line 4—4 in FIG. 2, illustrating the spout in the closed position.

FIG. 4 details the cap 30. The cap 30 has a flange ring 36 which flares outward just above the neck 34. The flange ring 36 rests upon the housing top 16. The housing 12 has a housing top lip 26 located above the housing top 16. The housing top lip 26 has a smaller inner diameter than the flange ring 36, and the flange ring extends between the housing top 16 and the housing top lip 26, trapping the flange ring therebetween. Therefore the cap 30 is held to the housing 12 with the housing top lip 26, but is permitted to rotate freely therebetween. The cap 30 has a cap top 38 opposite the flange ring 36.

The cap 30 has a spout cavity 60, and has a lower chamber 62 which is in fluid communication with the spout cavity 60 through a lower chamber channel 64. The lower chamber channel 64 has a lower chamber channel opening 66 which borders the spout cavity 60. The lower chamber 62 extends into the cap plug 32, and has a plurality of polygonal holes 68 which connect the lower chamber 62 with the hollow interior space 22. Thus viscous material can travel to the spout cavity 60 from the hollow interior space 22 through the polygonal holes 68, into the lower chamber 62, through the lower chamber channel 64, and then out the lower chamber channel opening 66.

The polygonal holes 68 are located in a horizontal ring around the cap plug 32 and are disposed along the tapered portion 35 of the cap plug 32.

The spout cavity 60 has a cylindrical hollow 70 and a nose groove 72 extending from the cylindrical hollow 70.

A spout 80 is located within the cylindrical hollow 70. The spout 80 has a spout disk 82 and a spout nose 84 extending from the spout disk 82. A conduit 86 extends through the spout disk 82 and through the spout nose 84. The spout disk is seated in the cylindrical hollow 70, and is pivotable therein to selectively bring the spout from a closed position to an olden position.

In the closed position, as shown in FIG. 4, the spout nose 84 is substantially horizontal, and the spout nose 84 is flush with the cap top 38. In the closed position a channel block 74, protruding from the spout disk, blocking the flow of material exiting from the lower chamber 62 through the lower chamber channel opening 66.

While initially in the closed position, a safety tab 88 extends across the cap top 38, and extends over the spout disk 82, so that the spout disk 82 may not leave the closed position and enter the open position without breaking the safety tab 88. Thus, an intact safety tab 88 indicates that the spout 80 has never been used.

Figure 5:
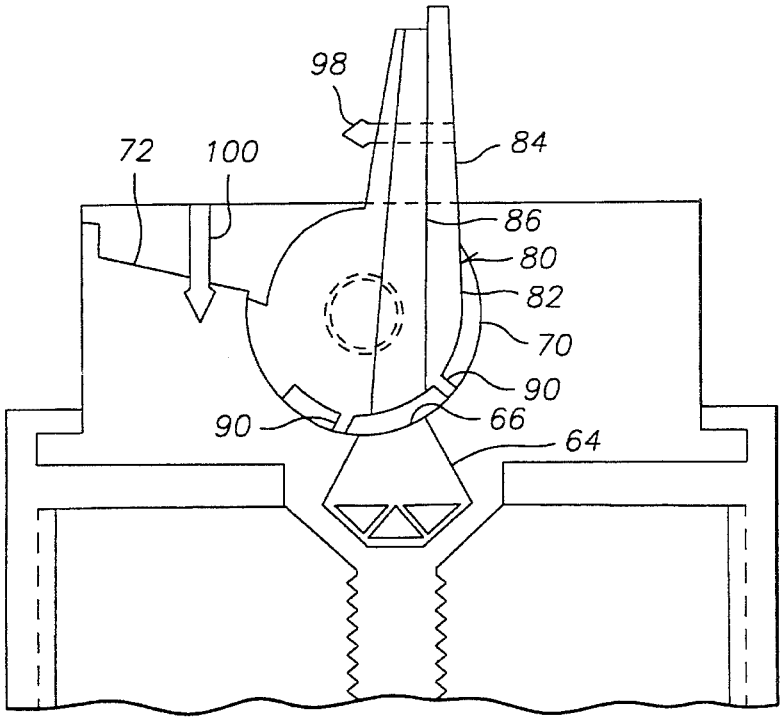
FIG. 5 is a cross-sectional view of the spout mechanism of the instant invention similar to FIG. 4, except with the spout in the open position.

From FIG. 5 it is apparent that the spout disk 82 is of a lesser diameter than the cylindrical hollow 70 in which it is seated, creating an open space between the lower chamber channel opening 66 and the conduit 86.

As illustrated in FIG. 5, the spout 80 is in the open position, with the spout nose 84 substantially vertical. In the open position, the conduit 86 is in fluid communication with the lower chamber channel 64 via the open space. A pair of membrane walls 90 are attached to the spout disk 82, to bridge the open space between the lower chamber channel opening 66 and the conduit 86 to focus the flow of the viscous material therebetween and to route the flow upward into the conduit 86. The membrane walls 90 serve an additional purpose in preventing material waste. When the spout 80 is rotated from the open position to the closed position after use, one of the membrane walls 90 wipes any excess material back into the lower chamber channel 64.

The spout nose has a diamond shaped rib 98 which encircles the spout nose 84 in a semicircular fashion. The nose groove 72 has a rib indentation 100 which corresponds to the shape of the diamond shaped rib 98. When the spout nose 84 is placed into the closed position with the spout nose 84 in the nose groove 72, the diamond shaped rib 98 locks into the rib indentation 100. The locked combination of the diamond shaped rib 98 and rib indentation 100 presents resistance to any tendency for the spout 80 to pivot into the open position if the housing 12 is inadvertently tipped over.

FIG. 5 illustrates an optional feature not illustrated in the other drawing figures. A cap sealing disk 37 extends horizontally outward from the neck 34 of the cap plug 32, and thus has a diameter larger than the neck 34. A cap sealing disk recess 39 extends horizontally into the housing top 16 from the housing top opening 18. The cap sealing disk 37 extends into the cap sealing disk recess 39, and is rotatable therein. The presence of the cap sealing disk 37 prevents material leakage, by presenting a longer path that material must take in order to leak out of the cap 30. Leaking material must first squeeze around the edges of the cap sealing disk 37 before it can get under the flange ring 36.

Figure 6:
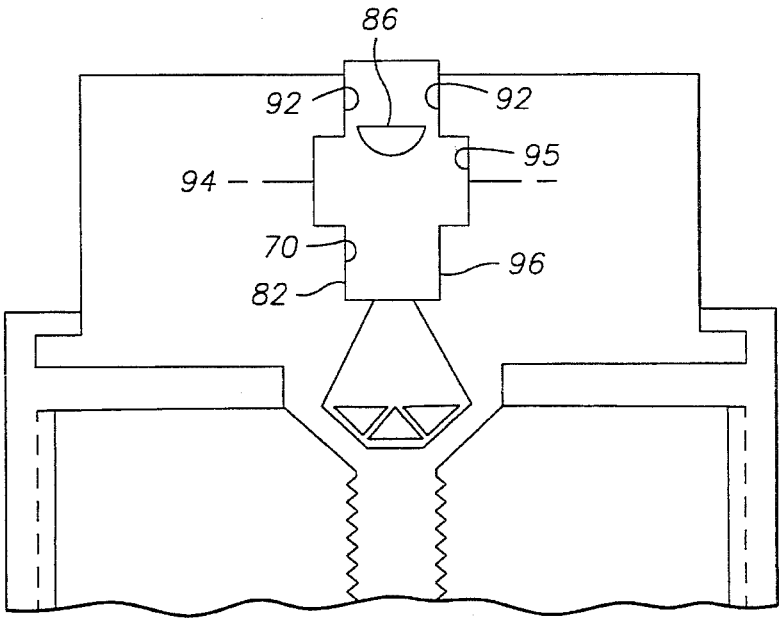
FIG. 6 is a cross sectional view taken on line 6—6 in FIG. 4, illustrating the spout mechanism.

FIG. 6 further illustrates the cylindrical hollow 70 and spout disk 82. The cylindrical hollow 70 has end walls 92. A cavity axis 94 extends horizontally through the center of both end walls 92. Axle recesses 95 extend into the end walls 92 from the cylindrical hollow 70 and are concentric with the end walls 92. The spout disk 82 has axles 96 which are concentric with the spout disk 82 which extend into the axle recesses 95. The spout disk 82 may pivot on the axles 96 about the cavity axis 94 between the closed position as shown in FIG. 6, wherein the conduit 86 is not in fluid communication with the lower chamber channel 64, and the open position as shown in FIG. 5. Also illustrated is that the conduit has a half cylindrical shape.

The apparatus is well adapted to assembly by nested bipartite construction, This method of construction may comprise the following steps:

A. The cap 30 is comprised of two symmetrical halves whereby the spout cavity 60 is bisected. The spout 80 is inserted into the spout cavity 60 as the cap halves are brought together.

B. The piston 50 is attached on the threaded rod 40, the threaded rod 40 is mated to the cap 30 via the cap plug 32.

C. The housing 12 is comprised of two symmetrical halves. The cap 30 is inserted into a first housing half with its flange ring 36 extending between the housing top lip 26 and the housing top 16, and the outer edge 52 of the piston 50 resting against the side walls 20. If the cap sealing recess 37 is present, the cap sealing disk 37 extends into the cap sealing disk recess 39. A second housing half is mated with the first housing half to create the hollow interior space 22 between the side walls 20 and to capture the cap to the housing 12.

It is important to note that the cap sealing disk feature could not be implemented unless some variation of bipartite construction is used.

Figure 2:
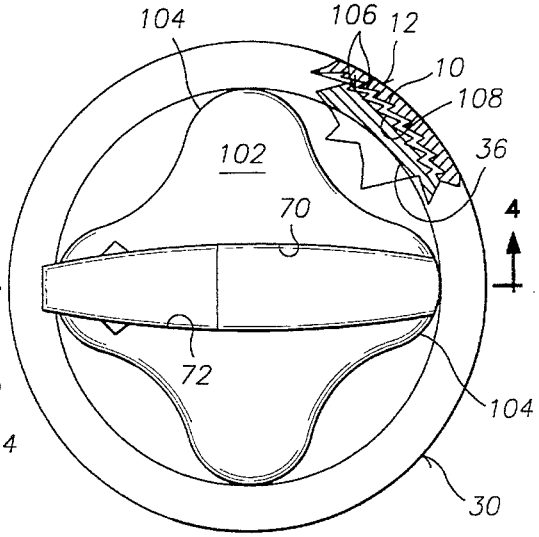
FIG. 2 is an plan view of the instant invention, illustrating the cap portion thereof, with parts broken away.

FIG. 2 is a plan view of the cap 30. The cap 30 has a knob 102 for allowing the cap 30 to be rotated easily. The knob 102 has four grips 104 extending radially from the cylindrical hollow 70 The nose groove 72 extends toward one of the grips 104. The grips 104 are joined with continuously curved surfaces, so that the knob 102 fits comfortably within a person's hand while the dispenser is being operated.

In FIG. 2, a portion of the housing top lip 26 is removed to illustrate a ratcheting mechanism 106, comprising a flange ratchet 108 on the flange ring 36 of the cap 30, and a housing ratchet 110 one the housing beneath the housing top lip 26. The ratcheting mechanism 106 only permits the housing 12 and cap 30 to rotate in one direction with respect to each other, in order to advance the piston toward the cap 30 only. Reverse rotation, which would tend to retract the piston away from the cap 30 is not permitted by the ratcheting mechanism 106.

In conclusion, a viscous materials dispenser has been presented that effectively and conveniently dispenses viscous materials while reducing waste, promoting accuracy and precision, all in an ergonomic and readily manufacturable package.

What is claimed is:

1. A viscous material dispenser, comprising:

a housing, the housing having a base, a housing top having a housing top opening, and side walls, said side walls substantially parallel to one another and defining a hollow interior space in which material to be dispensed is stored, the housing having at least one guide rail extending vertically along the side walls;

a cap, having a cap top, the cap seated on the housing top where it is rotatable, the cap having a spout cavity, and having a lower chamber, the lower chamber in fluid communication with the spout cavity and with the hollow interior space of the housing;

a threaded rod, the threaded rod extending in the hollow interior space from the cap to the base, the threaded rod mated to the cap so that the threaded rod rotates when the cap rotates, the threaded rod freely rotatable in the base;

a piston, the piston substantially flat, having an outer edge that matches the side walls, the piston substantially perpendicular to the threaded rod, the piston having at least one rail notch corresponding to the position and number of guide rails in the side walls, the piston advancing toward the cap upon rotation of the threaded rod, pushing the material in the hollow interior space toward the cap; and a spout, the spout having a spout conduit extending therethrough, the spout located in the spout cavity where it may be pivoted to selectively bring the spout conduit into and out of fluid communication with the lower chamber.

2. The apparatus as recited in claim 1, wherein the cap further comprises a cap plug which extends through the housing top opening, the cap plug has a neck which is substantially the same diameter as the housing top opening, the cap plug is conical in shape, having a tapered portion tapering from the neck to the threaded rod, the lower chamber extending into the cap plug, the lower chamber being in fluid communication with the hollow interior space of the housing through a plurality of polygonal holes disposed on the tapered portion of the cap plug.

3. The apparatus as recited in claim 2, wherein the piston has an upper surface which has a countersink that is concentric with the threaded rod and matches the taper of the cap plug, so that when the piston is advanced fully toward the cap the cap plug extends into the countersink to force any remaining viscous material into the lower chamber.

4. The apparatus as recited in claim 3, wherein:

the spout cavity further comprises a cylindrical hollow having end walls, a cavity axis extending through the center of both end walls, said cavity axis extending horizontally, the cylindrical hollow further having axle recesses which are concentric with the end walls and extend into the end walls, the spout cavity also having a nose groove extending from the cylindrical hollow;

the spout further comprises a spout disk which is seated in the cylindrical hollow, the spout having a spout nose which extends from the spout disk, the conduit extends through the spout nose and through the spout disk, the spout disk having axles concentric with the spout disk which extend into to the axle recesses, wherein the spout disk may pivot about the cavity axis to bring the spout from a closed position to an open position; and in the closed position the spout nose is substantially horizontal, the spout nose flush with the cap top and with the conduit out of fluid communication with the lower chamber, in the open position the spout nose is substantially vertical with the conduit in fluid communication with the lower chamber.

5. The apparatus as recited in claim 4, wherein the cap further comprises a knob, having grips which extend outward from the spout cavity, and the nose groove extends toward one of the grips.

6. The apparatus as recited in claim 4, wherein the spout has a diamond shaped rib projecting from the spout nose, the nose groove having a rib indentation corresponding to the diamond shaped rib so that the diamond shaped rib locks in the rib indentation securing the spout nose to the spout cavity when the spout is in the closed position.

7. The apparatus as recited in claim 4, wherein the spout disk is of a lesser diameter than the cylindrical hollow in which it is seated, said spout disk having a channel block which blocks the lower chamber when the spout is in the open position, and a membrane wall on each side of the spout conduit opening, so that material to be dispensed is routed directly upward into the spout conduit when the spout is in the open position.

8. The apparatus as recited in claim 4, further comprising a safety tab, extending across the cap top over a portion of the spout when the spout is initially in the closed position, so that the spout may not pivot into the open position without breaking the safety tab.

9. The apparatus as recited in claim 1, wherein the housing further comprises a transparent portion having an outer surface, the outer surface having dosage indicia indicated thereon, and the piston further comprises a colored ring at its outer edge that is visible through the transparent portion.

10. A viscous material dispenser, comprising:

a housing, the housing having a base, a housing top having a housing top opening, and side walls, said side walls transparent and having an outer surface having dosage indicia printed thereon, said side walls also substantially parallel to one another and defining a hollow interior space in which material to be dispensed is stored, the housing having a transparent portion having dosage indicia;

a cap, having a cap top, the cap seated on the housing top where it is rotatable;

a threaded rod, the threaded rod extending in the hollow interior space from the cap to the base, the threaded rod mated to the cap so that the threaded rod rotates when the cap rotates, the threaded rod freely rotatable in the base;

a piston, the piston substantially flat, having a colored ring at its outer edge that is visible through the transparent portion of the housing, having an outer edge that matches the side wall, the piston substantially perpendicular to the threaded rod, the piston advancing toward the cap upon rotation of the threaded rod, pushing the material in the hollow interior space toward the cap; and a spout, the spout located in the cap, the spout having a conduit in fluid communication with the hollow interior space of the housing.

11. The apparatus as recited in claim 10, wherein the cap further comprises a spout cavity, and has a lower chamber, the lower chamber in fluid communication with the spout cavity and with the hollow interior space of the housing.

12. The apparatus as recited in claim 11, wherein the spout is located in the spout cavity where it may be pivoted to selectively bring the spout conduit into and out of fluid communication with the lower chamber.

13. The apparatus as recited in claim 12, wherein the cap further comprises a cap plug which extends through the housing top opening, the cap plug has a neck which is substantially the same diameter as the housing top opening, the cap plug is conical in shape, tapering from the neck to the threaded rod, the lower chamber extending into the cap plug, the lower chamber being in fluid communication with the hollow interior space of the housing through a plurality of polygonal holes disposed on the taper of the cap plug.

14. The apparatus as recited in claim 13, wherein the housing top further comprises a cap sealing disk recess extending into the housing top from the housing top opening, and the cap further comprises a cap sealing disk, extending horizontally from the cap plug into the cap sealing disk opening.

15. The apparatus as recited in claim 10, further comprising a safety tab, extending across the cap top over a portion of the spout when the spout is initially in the closed position, so that the spout may not pivot into the open position without breaking the safety tab.

* * * * *